US007215283B2

(12) United States Patent
Boyle

(10) Patent No.: US 7,215,283 B2
(45) Date of Patent: May 8, 2007

(54) ANTENNA ARRANGEMENT

(75) Inventor: Kevin R. Boyle, Horsham (GB)

(73) Assignee: NXP B.V., Eindhoven (NL)

( * ) Notice: Subject to any disclaimer, the term of this patent is extended or adjusted under 35 U.S.C. 154(b) by 190 days.

(21) Appl. No.: 10/512,617

(22) PCT Filed: Apr. 17, 2003

(86) PCT No.: PCT/IB03/01538

§ 371 (c)(1),
(2), (4) Date: Oct. 26, 2004

(87) PCT Pub. No.: WO03/094290

PCT Pub. Date: Nov. 13, 2003

(65) Prior Publication Data

US 2006/0055606 A1 Mar. 16, 2006

(30) Foreign Application Priority Data

Apr. 30, 2002 (GB) ..... 0209818.4

(51) Int. Cl.
*H01Q 1/24* (2006.01)
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 5,943,016 A * 8/1999 Snyder, Jr. et al. ... 343/700 MS
6,229,487 B1 5/2001 Sadler et al.

FOREIGN PATENT DOCUMENTS

| | | | |
|---|---|---|---|
| EP | 0993070 | A1 | 4/2000 |
| EP | 0993070 | B1 | 4/2000 |
| EP | 0997974 | A1 | 5/2000 |
| EP | 0997974 | B1 | 5/2000 |
| JP | 2001274619 | A | 10/2001 |
| WO | WO02060005 | A1 | 8/2002 |
| WO | WO020071535 | A1 | 8/2002 |

* cited by examiner

*Primary Examiner*—Michael C. Wimer

(57) ABSTRACT

An antenna arrangement comprises a patch conductor (102) supported substantially parallel to a ground plane (104). The patch conductor includes first (106) and second (108) connection points, and further incorporates a slot (202) between the first and second points. The antenna can be operated in a first mode when the second connection point is connected to ground and in a second mode when the second connection point is open circuit. By connection of a variable impedance (514), for example a variable inductor, between the second connection point and the ground plane, operation of the arrangement at frequencies between the operating frequencies of the first and second modes is enabled.

10 Claims, 7 Drawing Sheets

ANTENNA ARRANGEMENT

The present invention relates to an antenna arrangement comprising a substantially planar patch conductor, and to a radio communications apparatus incorporating such an arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Further, PIFAs become reactive at resonance as the patch height is increased, which is necessary to improve bandwidth.

A further problem occurs when a dual band antenna is required. In this case two resonators are required within the same structure, which means that only part of the available antenna area is used effectively at each frequency. Since the bandwidth of an antenna is related to its size, even more volume is required to provide wideband operation in two bands. An example of such an antenna is disclosed in European patent application EP 0,997,974, in which two PIFA antennas are fed from a common point and share a common shorting pin. The low frequency element is wrapped around the high frequency element, which therefore means that the high frequency element must be small compared to the total antenna size (and therefore narrow band).

Our co-pending International patent application WO 02/60005 (unpublished at the priority date of the present application) discloses a variation on a conventional PIFA in which a slot is introduced in the PIFA between the feed pin and shorting pin. Such an arrangement provided an antenna having substantially improved impedance characteristics while requiring a smaller volume than a conventional PIFA.

Our co-pending International patent application WO 02/71535 (unpublished at the priority date of the present invention) discloses an improvement over WO 02/60005 enabling dual and multi-band use. By connecting different impedances to the feed pin and shorting pin, different current paths through the antenna are provided, each relating to a distinct mode. The disclosed arrangement enables the whole antenna structure to be used in all bands, thereby requiring a smaller volume than conventional multi-band PIFAs.

An object of the present invention is to provide an improved planar antenna arrangement.

According to a first aspect of the present invention there is provided an antenna arrangement comprising a substantially planar patch conductor, having first and second connection points for connection to radio circuitry and a slot incorporated between the points, and a ground plane, wherein the antenna arrangement would operate in a first mode having a first operating frequency if the second connection point were connected to the ground plane and in a second mode having a second operating frequency if the second connection point were open circuit, and wherein a variable impedance having a range of values between zero and infinite impedance is connected between the second connection point and ground, thereby providing operational frequencies of the antenna arrangement between the first and the second operating frequencies.

By enabling efficient operation of the antenna arrangement at frequencies between the known modes of operation, a compact wide bandwidth antenna is provided. The arrangement may for example operate as a Differentially Slotted PIFA in the first mode and as a Planar Inverted-L Antenna (PILA) in the second mode. The variable impedance may be an inductor. Additional connection points may be provided to enable further modes of operation.

According to a second aspect of the present invention there is provided a radio communications apparatus including an antenna arrangement made in accordance with the present invention.

Embodiments of the present invention will now be described, by way of example, with reference to the accompanying drawings, wherein.

In the drawings the same reference numerals have been used to indicate corresponding features.

Figure 1:
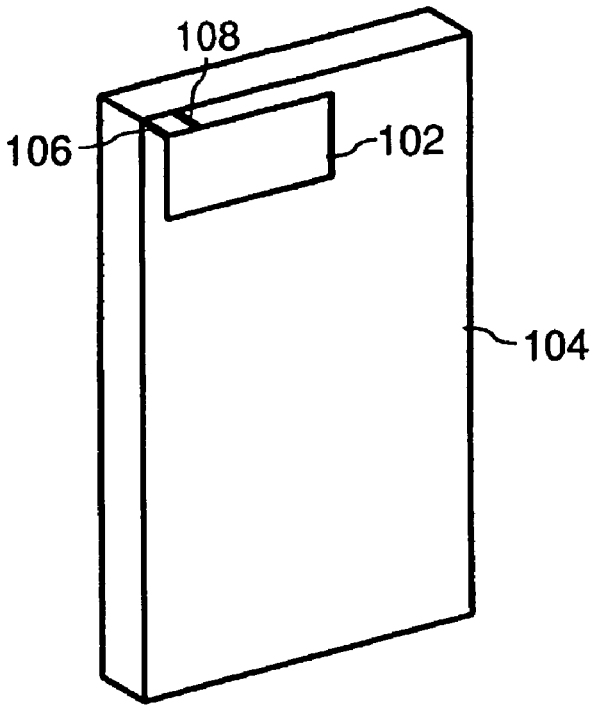
FIG. 1 is a perspective view of a PIFA mounted on a handset.

A perspective view of a PIFA mounted on a handset is shown in FIG. 1. The PIFA comprises a rectangular patch conductor 102 supported parallel to a ground plane 104 forming part of the handset. The antenna is fed via a first (feed) pin 106, and connected to the ground plane 104 by a second (shorting) pin 108.

In a typical example embodiment of a PIFA the patch conductor 102 has dimensions 20×10 mm and is located 8 mm above the ground plane 104 which measures 40×100×1 mm. The feed pin 106 is located at a corner of both the patch conductor 102 and ground plane 104, and the shorting pin 108 is separated from the feed pin 106 by 3 mm.

It is well known that the impedance of a PIFA is inductive. One explanation for this is provided by considering the currents on the feed and shorting pins 106, 108 as the sum of balanced mode (equal and oppositely directed, non-radiating) and radiating mode (equally directed) currents. For the balanced mode currents, the feed and shorting pins 106,108 form a short-circuit transmission line, which has an inductive reactance because of its very short length relative to a wavelength (8 mm, or 0.05λ at 2 GHz, in the embodiment shown in FIG. 1).

Figure 2:
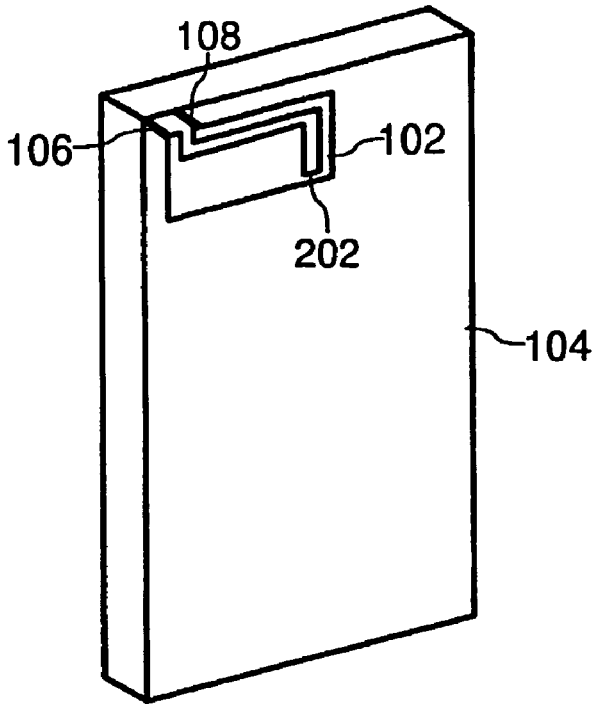
FIG. 2 is a perspective view of a slotted planar antenna mounted on a handset.

FIG. 2 is a perspective view of a variation on the standard PIFA, disclosed in our co-pending International patent application WO 02/60005 in which a slot 202 is provided in the patch conductor 102 between the feed pin 106 and shorting pin 108. The presence of the slot affects the balanced mode impedance of the antenna arrangement by increasing the length of the short circuit transmission line formed by the feed pin 106 and shorting pin 108, which enables the inductive component of the impedance of the antenna to be significantly reduced. This is because the slot 202 greatly increases the length of the short-circuit transmission line formed by the feed and shorting pins 106,108, thereby enabling the impedance of the transmission line to be made less inductive. This arrangement is therefore known as a Differentially Slotted PIFA (DS-PIFA).

It was also shown in WO 02/60005 that the presence of the slot provides an impedance transformation. This is because the DS-PIFA can be considered to be similar to a very short, heavily top-loaded folded monopole. The impedance transformation is by a factor of approximately four if the slot 202 is centrally located in the patch conductor 102. An asymmetrical arrangement of the slot 202 on the patch conductor 102 can be used to adjust this impedance transformation, enabling the resistive impedance of the antenna to be adjusted for better matching to any required circuit impedance, for example 50Ω.

Our co-pending International patent application WO 02/71535 discloses how a second operational band can be provided from the antenna shown in FIG. 2 by leaving the shorting pin 108 open circuit. In this mode the antenna functions as a meandered Planar Inverted-L Antenna (PILA), as disclosed in our co-pending International patent application WO 02/71541 (unpublished at the priority date of the present invention). Operation of a PILA can best be understood by recognising that the shorting pin in a conventional PIFA performs a matching function, but this match is only effective at one frequency and is at the expense of the match at other frequencies. Hence, in a PILA the shorting pin is omitted or left open circuit.

Figure 3:
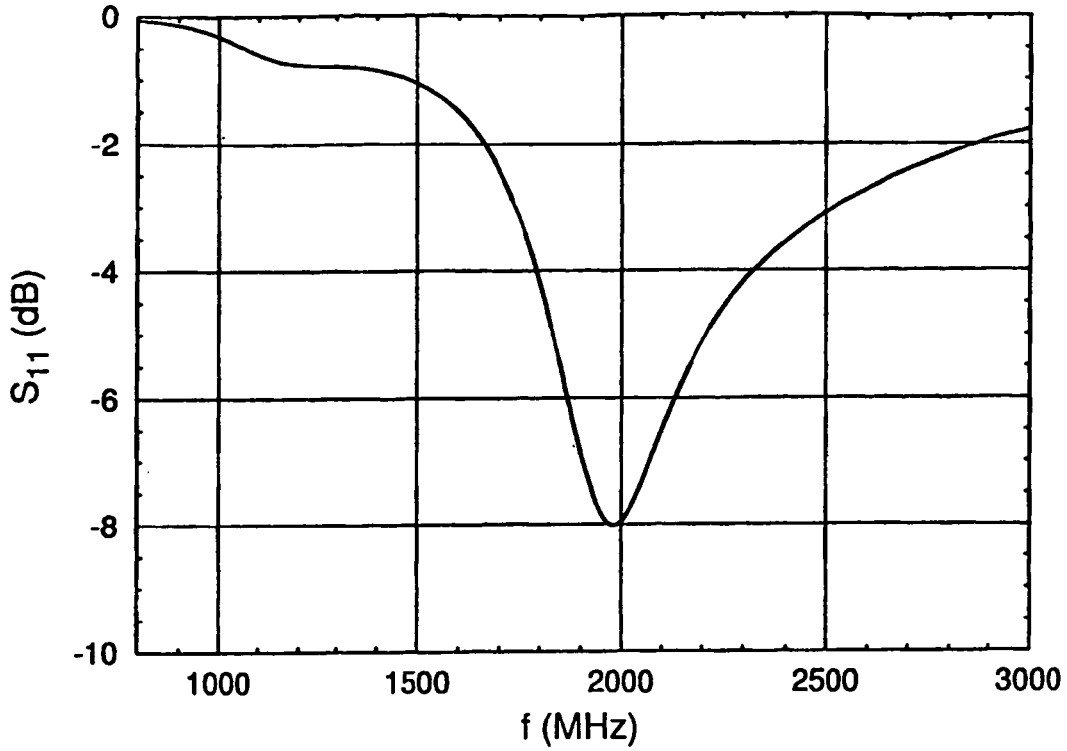
FIG. 3 is a graph of simulated return loss $S_{11}$ in dB against frequency f in MHz for the antenna of FIG. 2, with the first pin fed and the second pin grounded.
Figure 4:
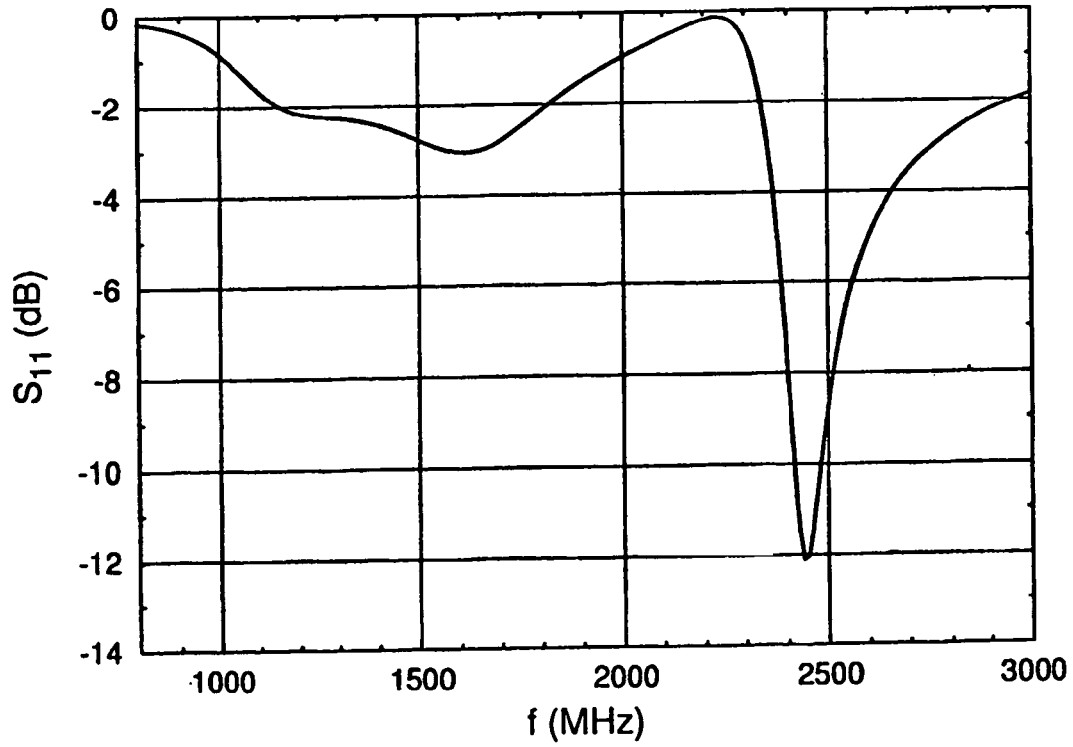
FIG. 4 is a graph of simulated return loss $S_{11}$ in dB against frequency f in MHz for the antenna of FIG. 2, with the first pin fed and the second pin open circuit.

Hence, dual-mode operation is enabled by connecting the second pin 108 to ground via a switch. When the switch is closed the antenna functions as a DS-PIFA, and when the switch is open the antenna functions as a meandered PILA. Simulations were performed to determine the performance of an antenna having the typical PIFA dimensions detailed above. The slot 202 is 1 mm wide, starts centrally between the two pins 106,108 then runs parallel to the edge of the patch conductor 102 and 0.5 mm from its edge. FIGS. 3 and 4 show simulated results for the return loss $S_{11}$ in DS-PIFA and PILA modes respectively. Alternative modes of operation are provided by reversing the roles of the first and second pins 106,108: in the DS-PIFA mode the frequency response is similar but the antenna impedance is significantly increased; in the PILA mode the resonant frequency is reduced to approximately 1150 MHz because the full length of the section of the patch conductor 102 above and to the right of the slot 202 is in operation.

Figure 5:
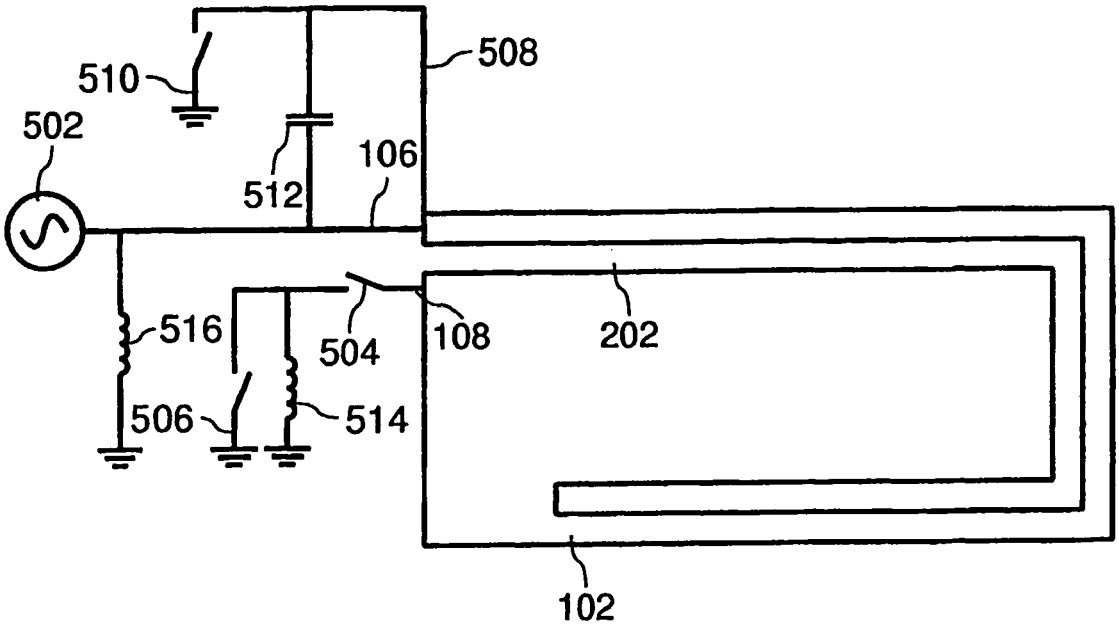
FIG. 5 is a plan view of an antenna arrangement tunable over a wide frequency range.

The present invention addresses the requirement for antennas which can operate over a wide bandwidth, rather than in a limited number of discrete bands. A plan view of an embodiment of the present invention is shown in FIG. 5. The patch conductor 102 has dimensions 23×11 mm and is located 8 mm above the ground plane 104. The slot 202 has a width of 1 mm, runs parallel to and 1 mm from the top and right and bottom edges of the patch conductor 102 and ends 4.5 mm from the left edge of the patch conductor. A RF signal source 502 is fed to the patch conductor 102 via the first pin 106. The second pin 108 is connected to first and second switches 504,506, and a third pin 508 is provided, connected to a third switch 510. The basic operation of the antenna comprises three modes, for operation in GSM (Global System for Mobile Communications), DCS and PCS (Personal Communication. Services) frequency bands. A fourth mode to cover UMTS (Universal Mobile Telecommunication System) could easily be added.

In a first low frequency (GSM) mode, around 900 MHz, the first switch 504 is open, the third switch 510 is closed, connecting the third pin 508 to the ground plane 104, and the antenna operates as a meandered PIFA. A capacitor 512, connected between the first and third pins 106, 508, tunes out the balanced mode inductance of the meandered PIFA and provides a degree of broadbanding.

In a second high frequency (PCS) mode, around 1900 MHz, the third switch 510 is open while the first and second switches 504,506 are closed, connecting the second pin 108 to the ground plane 104, and the antenna operates as a DS-PIFA. In a third (DCS) mode, around 1800 MHz, the second switch is opened thereby loading the second pin 108 with an inductor 514, which has the effect of lowering the resonant frequency. A shunt inductor 516 is provided to balance out the capacitive impedance of the antenna in DCS and PCS modes, caused by the length of the slot 202. Its effect is countered in GSM mode by the shunt capacitor 512, which is not in circuit in DCS and PCS modes.

Figure 6:
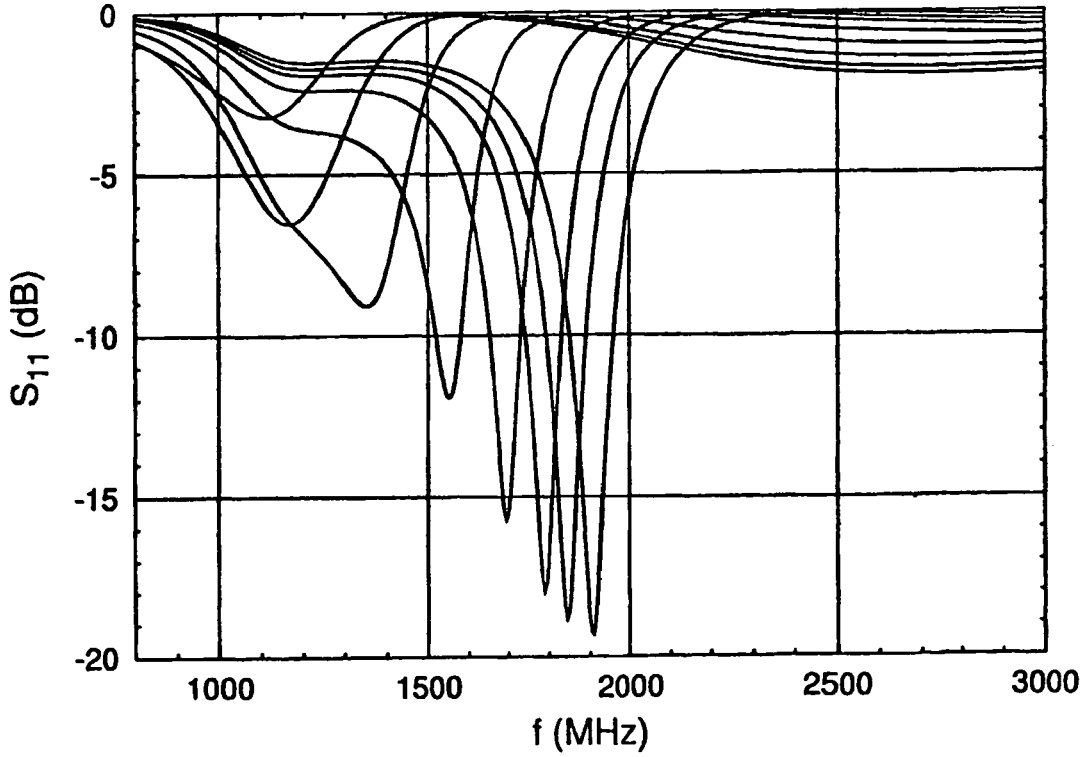
FIG. 6 is a graph of simulated return loss $S_{11}$ in dB against frequency f in MHz for the antenna of FIG. 5, with the value of the inductor loading the second pin varied from 0 to 64 nH.

By varying the value of the inductor 514, the antenna can be tuned over a wide frequency range. When the inductor 514 has a small value, the second pin 108 is close to being grounded and the antenna functions as a DS-PIFA. When the inductor 514 has a high value, the second pin 108 is close to open circuit and the antenna functions as a meandered PILA. FIG. 6 is a graph of simulated return loss $S_{11}$ with the second and third switches 506,510 open circuit and the value of the inductor 514 varied from 0 to 64 nH. In this figure, the response having the highest frequency resonance corresponds to an inductor value of 0 nH, the next highest to an inductor value of 1 nH, with subsequent curves corresponding to successive doubling of the inductor value to a maximum of 64 nH. The responses are simulated in a 200Ω system (reflecting the high radiating mode impedance transformation because of the slot location, necessary for an effective meander in GSM mode).

A variable inductor 514 can be implemented in a number of ways. One way is to provide a range of inductors which can be switched individually and in combination to provide a range of values. Another way is to provide a continuously variable capacitor in parallel with the inductor, provided the frequency is below the anti-resonance frequency of the parallel combination of the capacitor and inductor (the anti-resonance frequency being tuned by the capacitor). Such a capacitor could for example be a varactor (at low power levels) or a MEMS (Micro ElectroMagnetic Systems) device. For switching in the variable inductor, as well as the first, second and third switches 504,506,510, MEMS switches are particularly appropriate because of their low on resistance and high off resistance.

It can clearly be seen that the antenna can be tuned over a bandwidth of nearly an octave. However, the resistance at resonance of the meandered PILA mode is much lower than that of the DS-PIFA mode, because the location of the slot 202 provides no impedance transformation in the meandered PILA mode. Hence, the match deteriorates as the resonant frequency is reduced. Despite this, tuning over a range of approximately 200–300 MHz is possible without significant degradation of the match. This is sufficient to cover UMTS, PCS and DCS frequency bands.

Figure 7:
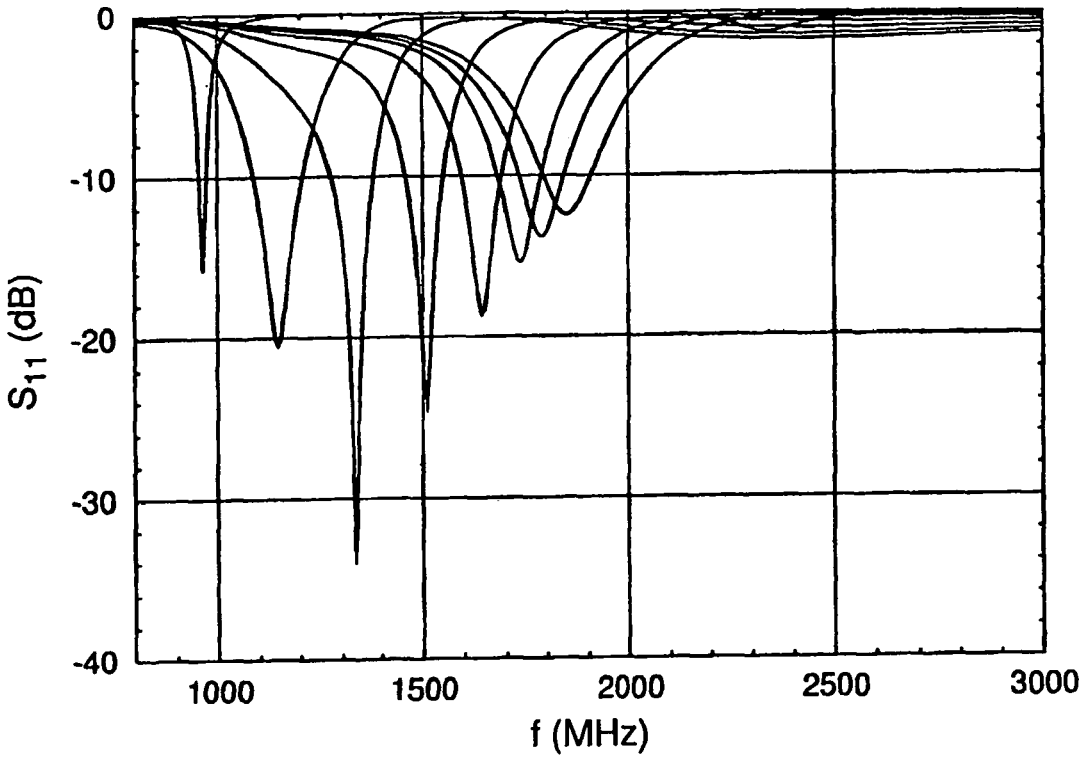
FIG. 7 is a graph of simulated return loss $S_{11}$ in dB against frequency f in MHz for the antenna of FIG. 5, with additional matching and with the value of the inductor loading the second pin varied from 0 to 64 nH.

The match can be significantly improved by use of a matching circuit which provides a larger upward impedance transformation at low frequencies is than at high frequencies. A simple example of this is a series capacitor connected to the antenna followed by a shunt inductor. Using a capacitance of 2 pF and an inductance of 25 nH, the simulated results are modified to those shown in FIG. 7. Here the match is much better maintained over the full tunable frequency range. A higher impedance could also be achieved by closing the third switch 510: this will have little effect on the frequency responses but the antenna will then function as a meandered PIFA rather than a meandered PILA for high values of the inductor 514.

Figure 8:
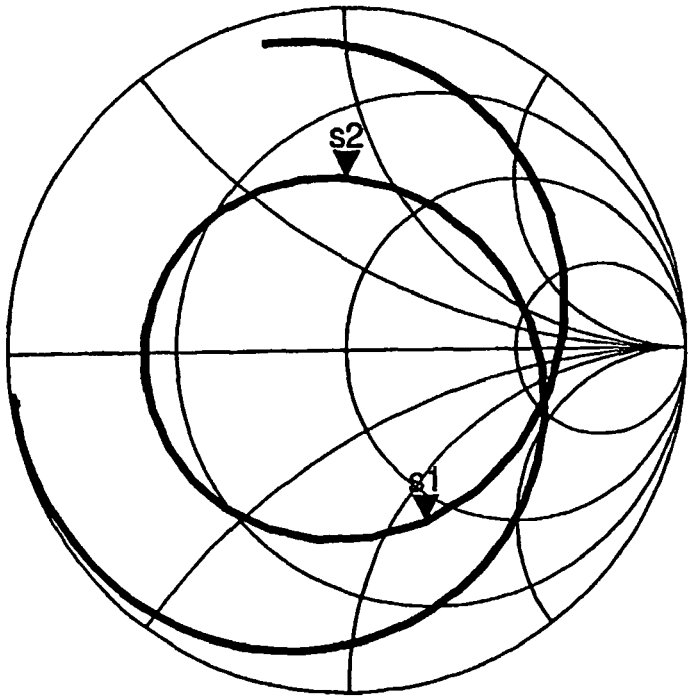
FIG. 8 is a Smith chart showing simulated return loss $S_{11}$ for the antenna of FIG. 5 in GSM mode over the frequency range 800 to 3000 MHz.

Returning to the basic antenna of FIG. 5 in GSM mode, FIG. 8 is a Smith chart showing its simulated return loss. The marker s1 corresponds to a frequency of 880 MHz and the marker s2 to a frequency of 960 MHz. The switches are simulated as MEMS switches with a series resistance of 0.5Ω in the on state and a series reactance of 0.02 pF in the off state. Although the return loss $S_{11}$ is not especially good, at approximately −5 dB in band, it is sufficient to pass through the switches without significant loss, when the transmit and receive bands can be individually matched to an acceptable level.

Figure 9:
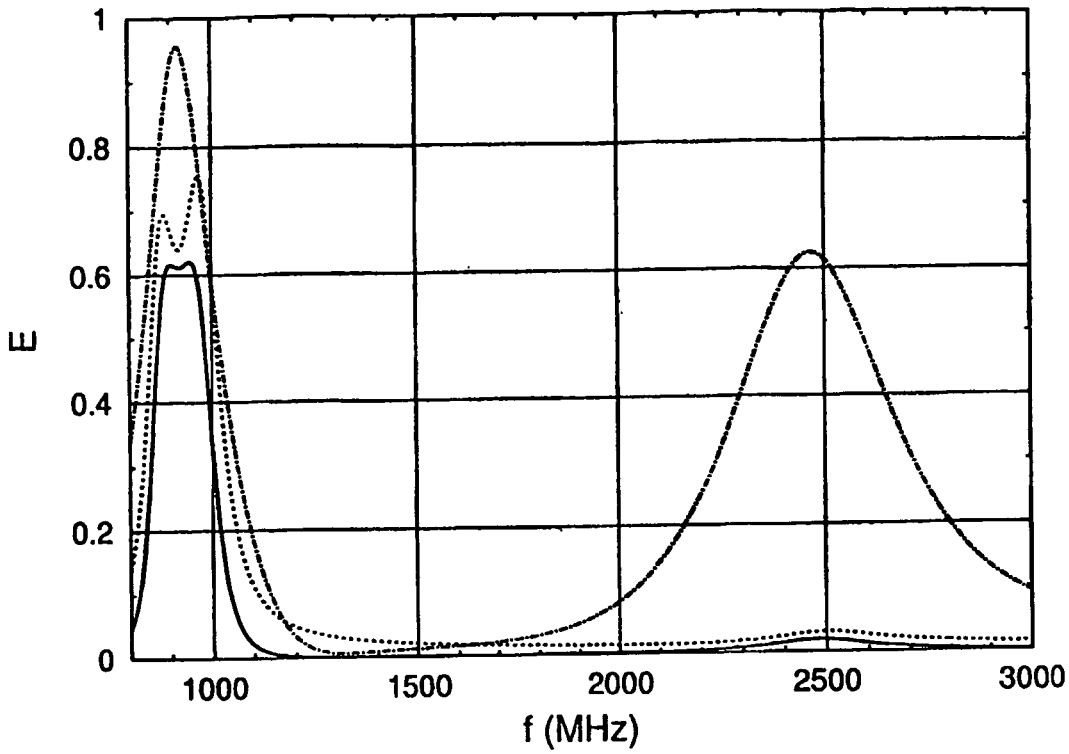
FIG. 9 is a graph showing the efficiency E against frequency f in MHz for the antenna of FIG. 5 in GSM mode.

The efficiency E of the antenna in GSM mode is shown in FIG. 9, where the mismatch loss is shown as a dashed line, the circuit loss as a chain-dashed line, and the combined loss as a solid line. These results are based on a capacitor 512 having a Q of 200, which is high but feasible. A good quality capacitor is necessary because it forms a parallel resonant circuit with the inductance of the antenna. It is clear that the overall efficiency is controlled by the return loss, while circuit losses are less than 25%.

Figure 10:
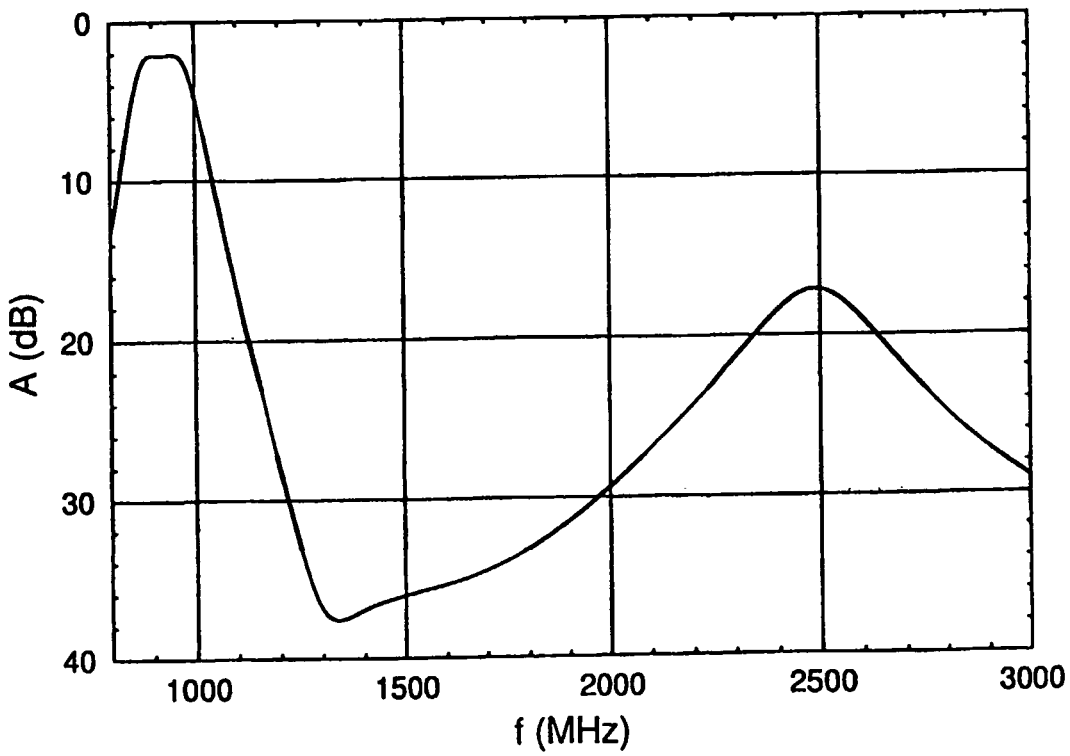
FIG. 10 is a graph showing the attenuation A in dB against frequency f in MHz for the antenna of FIG. 5 in GSM mode.

The inductive nature of the antenna combined with the capacitive tuning from the capacitor 512 results in the antenna acting as a good filter. FIG. 10 shows the attenuation A (in dB) of the antenna, demonstrating that it provides over 30 dB rejection of the second harmonic, and about 20 dB rejection of the third harmonic. This attenuation could be further improved by the addition of a conductor linking the first and third pins 106,508, as disclosed in our co-pending unpublished International patent application IB 02/02575 (Applicant's reference PHGB 010120).

Figure 11:
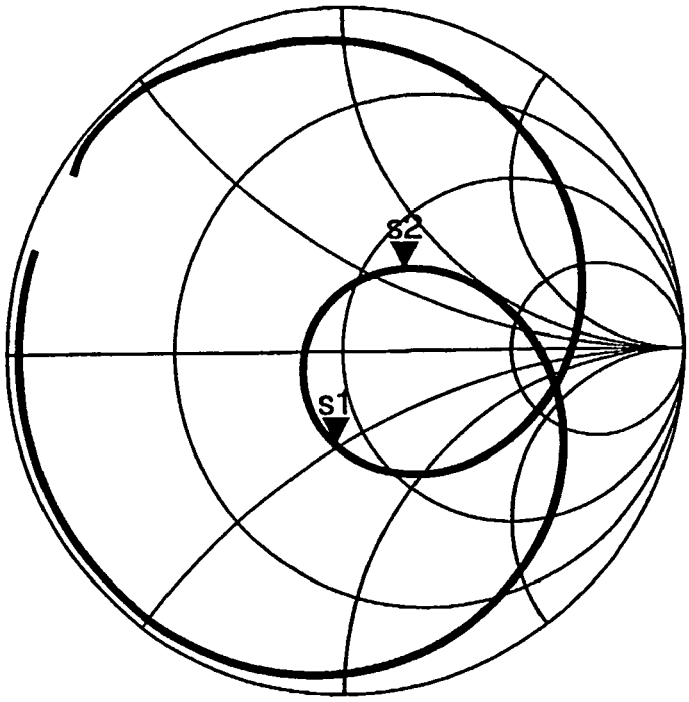
FIG. 11 is a Smith chart showing simulated return loss $S_{11}$ for the antenna of FIG. 5 in PCS mode over the frequency range 800 to 3000 MHz.
Figure 12:
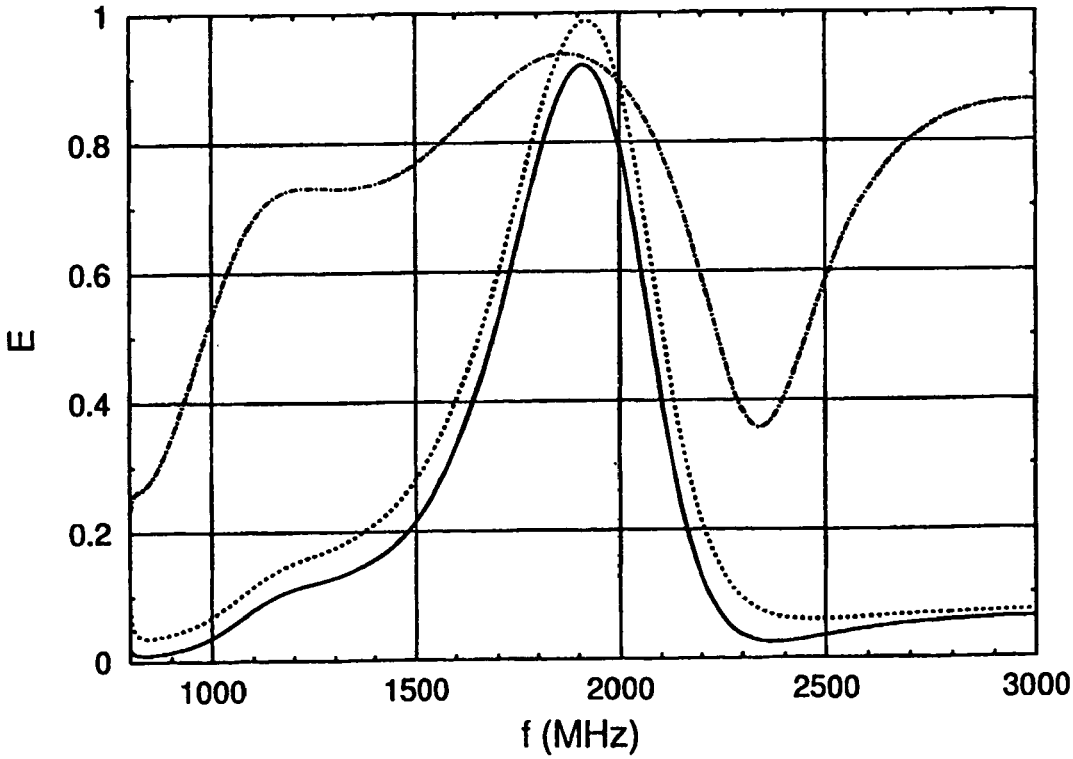
FIG. 12 is a graph showing the efficiency E against frequency f in MHz for the antenna of FIG. 5 in PCS mode.

Considering now the antenna of FIG. 5 in PCS mode, FIG. 11 is a Smith chart showing its simulated return loss. The marker s1 corresponds to a frequency of 1850 MHz and the marker s2 to a frequency of 1990 MHz. Here the match is very good, although at a high impedance of 200Ω. This is because of the large radiating mode impedance transformation provided by the location of the slot 202, which is required for an effective meander in GSM mode. However, a high impedance can be advantageous for switching, and it can be reduced if the height of the antenna is reduced. The efficiency E of the antenna in PCS mode is shown in FIG. 12, where the mismatch loss is shown as a dashed line, the circuit loss as a chain-dashed line, and the combined loss as a solid line. The circuit losses are approximately 10%.

Figure 13:
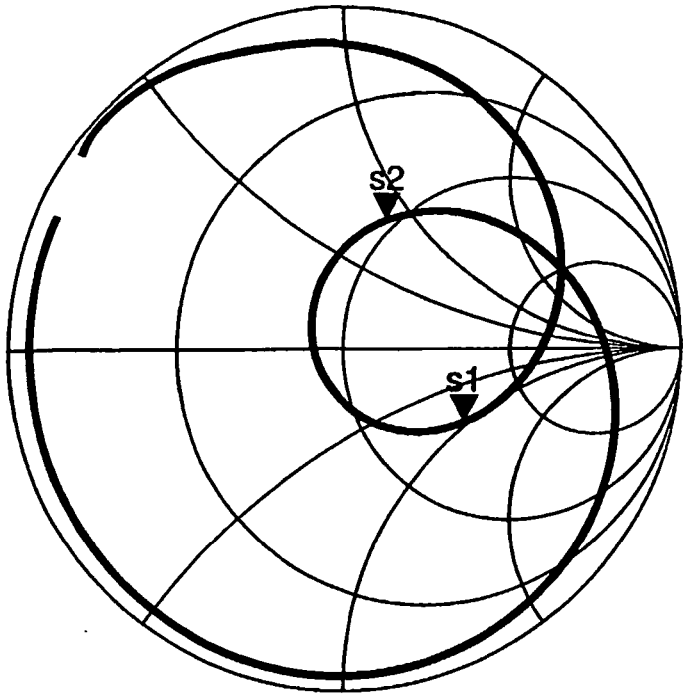
FIG. 13 is a Smith chart showing simulated return loss $S_{11}$ for the antenna of FIG. 5 in DCS mode over the frequency range 800 to 3000 MHz.
Figure 14:
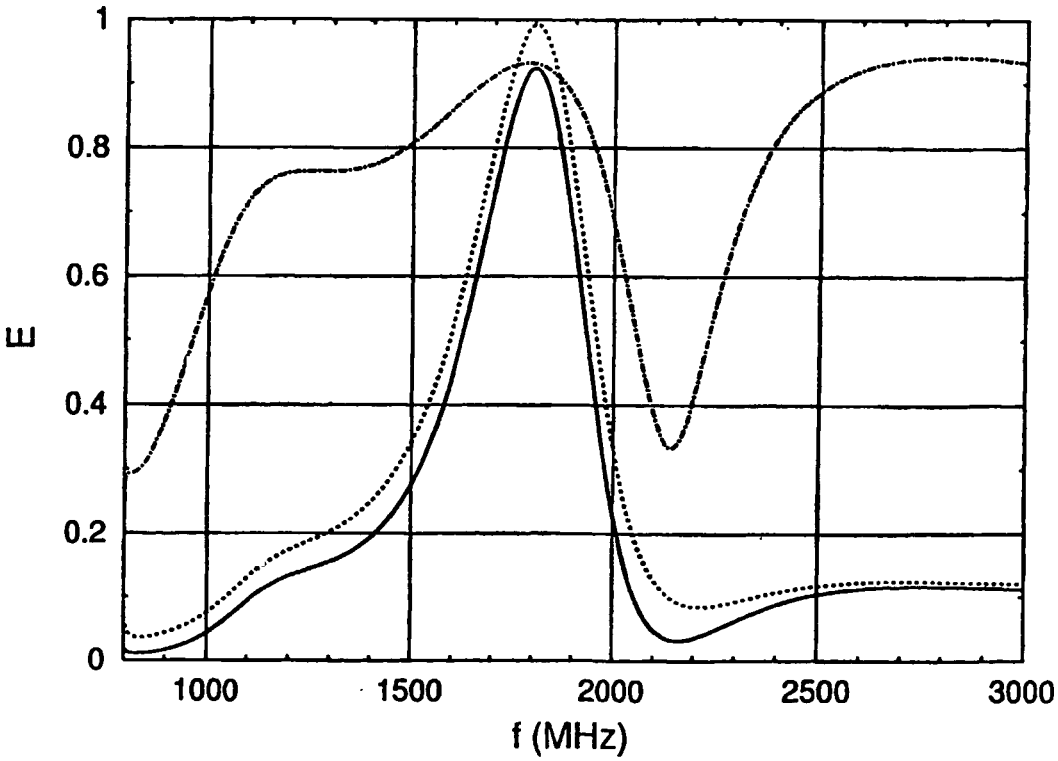
FIG. 14 is a graph showing the efficiency E against frequency f in MHz for the antenna of FIG. 5 in DCS mode.

Considering next the antenna of FIG. 5 in DCS mode, FIG. 13 is a Smith chart showing its simulated return loss. The marker s1 corresponds to a frequency of 1710 MHz and the marker s2 to a frequency of 1880 MHz. In this mode, inductive loading of the second pin 108 by the inductor 514 is used. The match and bandwidth are similar to those for the PCS mode. The efficiency E, shown in FIG. 14 (with the same meanings for line types as previously), is also similar to that in PCS mode, despite the inductive loading in the shorting pin.

It will be apparent that the provision of the third pin 508 and the associated mode of operation when the third switch is closed is not an essential feature of the present invention, which merely requires a first connection to the patch conductor 102 for signals and a second connection between the patch conductor 102 and ground plane 104 having a variable impedance which can take a range of values between open and short circuit. A wide range of alternative embodiments having additional connection points and/or additional slots is possible. Similarly, the present invention may be implemented without the need for any switches.

In a further variation on the embodiments described above, the third pin 508 can also be inductively loaded, thereby enabling coverage of cellular transmissions around 824 to 894 MHz. Provision of a further switch and inductor connected to the third pin 508, in a similar arrangement to the first switch 504 and associated inductor 514 connected to the second pin 108, would enable coverage of this band and the GSM band.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

The invention claimed is:

1. A antenna arrangement comprising a substantially planar patch conductor (102), having first (106) and second (108) connection points for connection to radio circuitry and a slot (202) incorporated between the points, and a ground plane (104), wherein the antenna arrangement operates in a first mode having a first operating frequency when the second connection point (108) is connected to the ground plane (104) and in a second mode having a second operating frequency when the second connection (108) point is not connected to the ground plane (104), and wherein a variable impedance having a range of values between zero and infinite impedance (514) is connected between the second connection point (108) and ground, thereby providing operational frequencies of the antenna arrangement between the first and the second operating frequencies, without changing the physical dimensions of the planar patch conductor.

2. An arrangement as claimed in claim 1, wherein the ground plane (104) is spaced from, and co-extensive with, the patch conductor (102).

3. An arrangement as claimed in claim 1, wherein the slot (202) is positioned asymmetrically in the patch conductor (102), thereby providing an impedance transformation.

4. An arrangement as claimed in claim 1, wherein the arrangement operates as a differentially-slotted PIFA in the first mode and as a planar inverted-L antenna in the second mode.

5. An arrangement as claimed in claim 1, wherein the variable impedance (514) comprises a variable inductor.

6. An arrangement as claimed in claim 5, wherein the variable inductor (514) is implemented as a plurality of different inductors connected via switching means.

7. An arrangement as claimed in claim 6, wherein the switching means comprises MEMS switches.

8. An arrangement as claimed in claim 5, wherein the variable inductor (514) is implemented as a variable capacitor in parallel with an inductor.

9. An arrangement as claimed in claim 8, wherein the variable capacitor comprises MEMS devices.

10. A radio communications apparatus including an antenna arrangement as claimed in claim 1.

* * * * *